US010418024B1

(12) United States Patent
Seymour et al.

(10) Patent No.: US 10,418,024 B1
(45) Date of Patent: Sep. 17, 2019

(54) SYSTEMS AND METHODS OF SPEECH GENERATION FOR TARGET USER GIVEN LIMITED DATA

(71) Applicant: salesforce.com, inc., San Francisco, CA (US)

(72) Inventors: John Seymour, Bellevue, WA (US); Azeem Aqil, Bellevue, WA (US)

(73) Assignee: salesforce.com, inc., San Francisco, CA (US)

( * ) Notice: Subject to any disclaimer, the term of this patent is extended or adjusted under 35 U.S.C. 154(b) by 0 days.

(21) Appl. No.: 16/035,915

(22) Filed: Jul. 16, 2018

Related U.S. Application Data

(60) Provisional application No. 62/659,115, filed on Apr. 17, 2018, provisional application No. 62/669,409, filed on May 10, 2018.

(51) Int. Cl.
*G10L 13/033* (2013.01)
*G10L 13/08* (2013.01)
*G10L 13/047* (2013.01)

(52) U.S. Cl.
CPC ..... *G10L 13/0335* (2013.01); *G10L 13/047* (2013.01); *G10L 13/08* (2013.01)

(58) Field of Classification Search
CPC .... G10L 13/0335; G10L 13/08; G10L 13/047
See application file for complete search history.

(56) References Cited

U.S. PATENT DOCUMENTS 6,240,384 B1 * 5/2001 Kagoshima ..... G10L 13/07 704/220
10,186,251 B1 * 1/2019 Mohammadi ..... G10L 13/047
2003/0028376 A1 * 2/2003 Meron ..... G10L 13/06 704/258
2008/0082320 A1 * 4/2008 Popa ..... G10L 13/033 704/201
2009/0037179 A1 * 2/2009 Liu ..... G10L 13/033 704/260
2014/0114663 A1 * 4/2014 Lin ..... G10L 13/033 704/260
2015/0127350 A1 * 5/2015 Agiomyrgiannakis ..... G10L 13/02 704/266

(Continued)

OTHER PUBLICATIONS

Fernandez, Raul, et al. "Voice-transformation-based data augmentation for prosodic classification." 2017 IEEE International Conference on Acoustics, Speech and Signal Processing (ICASSP). IEEE, 2017. (Year: 2017).*

(Continued)

*Primary Examiner* — Brian L Albertalli
(74) *Attorney, Agent, or Firm* — Morris & Kamlay LLP

(57) ABSTRACT

Systems and methods are provided for training an audio generation model for a first person using a first voice audio data and a first text transcript of the first voice audio data. Using a second voice audio data and a second text transcript of the second voice audio data, a plurality of pitch voice audio data for the second person may be generated with different pitches. The audio generation model may be trained for the second person using the generated plurality of pitch voice audio data with the different pitches for the second person. Output voice audio may be generated for the second person using received text and the model trained with the generated plurality of pitch voice audio data.

18 Claims, 5 Drawing Sheets

(56) References Cited

U.S. PATENT DOCUMENTS

| | | | | |
|---|---|---|---|---|
| 2015/0325248 | A1* | 11/2015 | Conkie | G11C 7/16 704/207 |
| 2017/0040016 | A1* | 2/2017 | Cui | G10L 15/063 |
| 2017/0301340 | A1* | 10/2017 | Yassa | G10L 13/033 |
| 2018/0336880 | A1* | 11/2018 | Arik | G10L 15/04 |
| 2018/0350348 | A1* | 12/2018 | Fukuda | G10L 15/063 |
| 2019/0130896 | A1* | 5/2019 | Zhou | G10L 15/063 |

OTHER PUBLICATIONS

Hartmann, William, et al. "Two-Stage Data Augmentation for Low-Resourced Speech Recognition." Interspeech. 2016. (Year: 2016).*

Kain, Alexander, and Michael W. Macon. "Text-to-speech voice adaptation from sparse training data." Fifth International Conference on Spoken Language Processing. 1998. (Year: 1998).*

Kain, Alexander, and Mike Macon. "Personalizing a speech synthesizer by voice adaptation." The Third ESCA/COCOSDA Workshop (ETRW) on Speech Synthesis. 1998. (Year: 1998).*

* cited by examiner

SYSTEMS AND METHODS OF SPEECH GENERATION FOR TARGET USER GIVEN LIMITED DATA

BACKGROUND

To generate speech for a particular person, present neural network based systems require 24-50 hours of audio with accompanying transcriptions. To generate speech for a new person, such present systems would require the same amount of audio (i.e., 24-50 hours) and transcripts to re-train the system for the new person.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description explain the principles of implementations of the disclosed subject matter. No attempt is made to show structural details in more detail than can be necessary for a fundamental understanding of the disclosed subject matter and various ways in which it can be practiced.

DETAILED DESCRIPTION

Figure 1A:
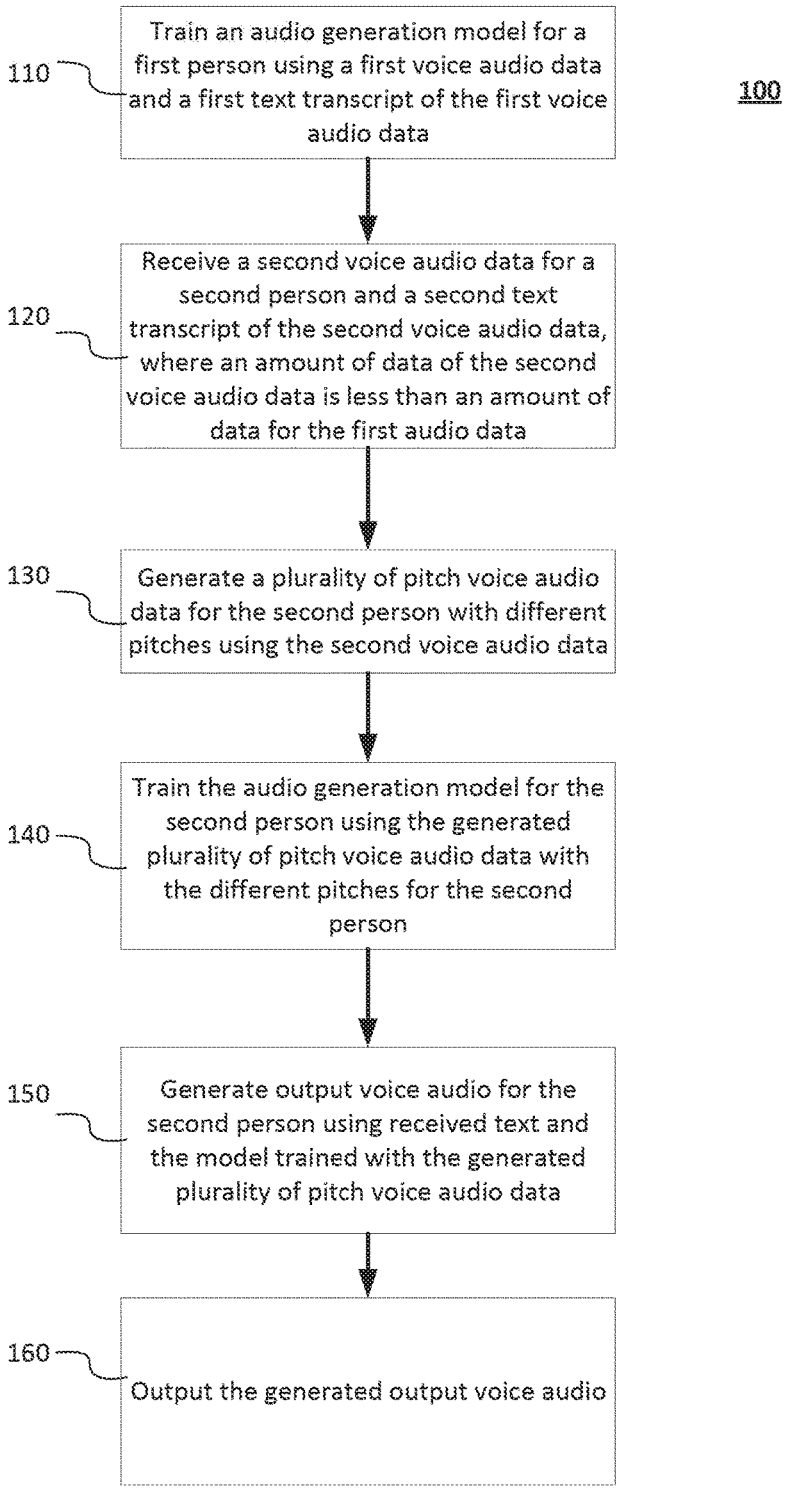
FIGS. 1A-1C show a method of training an audio generation model and generating output audio according to an implementation of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosure can be practiced without these specific details, or with other methods, components, materials, etc. In other instances, well-known structures and devices are shown in block diagram form to facilitate describing the subject disclosure.

Implementations of the disclosed subject matter provide systems and techniques to decrease the amount of data needed to generate voice audio with a given voice of a person. An audio generation model may be trained for a first person that a predetermined amount of voice data available is available for (e.g., 24-50 hours of voice audio and transcriptions of the voice audio, where the model learns the connection between the transcription and the voice audio). To generate speech for a new person (e.g., a second person), the audio generation model trained for the first person may be trained with voice data and transcripts of the second person, where the voice data used for training the model for the second person includes different pitches of the voice data of the second person. That is, the system of the disclosed subject matter may be generally trained for a first person for which a substantial amount of voice data and transcripts are available, and the system is trained to generate voice audio for a second person using a few examples of speech audio and related transcripts. The amount of audio and transcript data for the second person (e.g., one hour of audio) is substantially less than for the first person (e.g., 24-50 hours of audio).

In implementations of the disclosed subject matter, initial voice audio data (and accompanying transcripts) for the second person may include a relatively small amount of audio data, such as 5 minutes of recorded speech. A plurality of versions are made from this initial voice audio data at different pitches to produce a larger amount of voice audio data to train the audio generation model for the second person. As a specific, non-limiting example, 20 different sets of voice audio data may be generated, each at a different pitch that may be above or below the reference pitch of the initial voice audio data, to generate about an hour of voice audio data that can be used to train the model for the second person. That is, voice audio data may be generated with pitches above and below the pitch of the initial voice audio data to train the model for the pitch and/or accent of the new person. For example, 10 different voice audio data segments may be generated having a higher pitch, and 10 different voice audio data segments may be generated having a lower pitch.

Implementations of the disclosed subject matter provide improvements over present systems by decreasing the amount of audio data and transcripts to train a system to generate audio for a new person for which the system has not been previously trained, thereby improving the efficiency of the computerized processing system, as well as decreasing the amount of storage and communications overhead necessary to train a system on new audio data. A short, high quality segment of voice audio data (e.g., without background noise, distortion, or the like) may be used for the second person, which may be easier to obtain than the 24-50 hours of voice audio data typically needed. The short length may also increase the ease of generating a transcript (e.g., the amount of time and/or effort to generate a transcript) and accuracy of the transcript (e.g., it may be easier to generate accurate transcripts and to verify the accuracy with a smaller segment of voice audio data than is typically used). The use of the high quality audio and accurate transcripts may increase the ability of audio generation model to output realistic representations of the second person's voice as output voice audio.

That is, the system and methods of the disclosed subject matter that may be used to train an audio generation model to generate voice audio for a first person may be re-trained to generate voice audio for a second person, without having to use the same amount of audio and transcript data that was needed to train the first person. A small, high quality segment of voice audio data for a second person may be used (e.g., 5 minutes of audio), which may increase the ease of making generating accompanying transcripts that are accurate. The small segment of voice audio data for the second person is used to generate about one hour of voice audio data by generating different sets of voice audio data at different pitches to train the audio generation model to generate speech for the second person. That is, substantially less data may be used to train the audio generation model to output voice audio for a second person than the first person, and the different sets of voice audio data having different pitches allows for the audio generation model to mimic and/or match the speech patterns and accent of the second person.

When the audio generation model is trained with the voice audio data for the first person and the second person, output voice audio for the second person may be generated using received text. The generated output voice audio for the second person may be at an audio output device.

The generation of audio for a given person may be useful for testing security systems (e.g., useful in testing speaker authentication), home automation systems, and for audio/video entertainment (e.g., voices for movies when actor unavailable; generating speech audio for audiobook content, etc.). For example, financial institutions, home automation products, and/or security systems (e.g., for a home, office, and/or manufacturing facilities) may use voice fingerprinting as a method for authentication. That is, voice authentication methods have been deployed in financial institutions to reduce fraud, home automation systems to allow for simpler shopping, mobile phones for command recognition. The generation of audio for a given person using the systems and methods of the disclosed subject matter may be used to test whether such voice fingerprinting authentication systems may be susceptible to targeted text-to-speech attacks. This may help develop systems to minimize and/or prevent attackers from, for example, being able to unlock mobile devices, issue malicious commands, gain entry to offices and/or manufacturing facilities, and/or bypass voice fingerprinting to authorize large financial transactions.

Figure 1B:
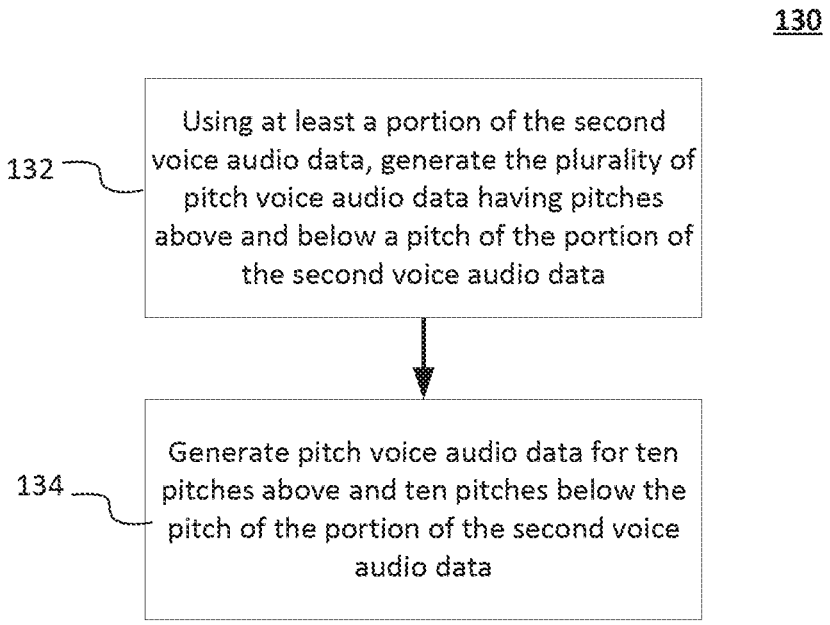
Figure 1C:
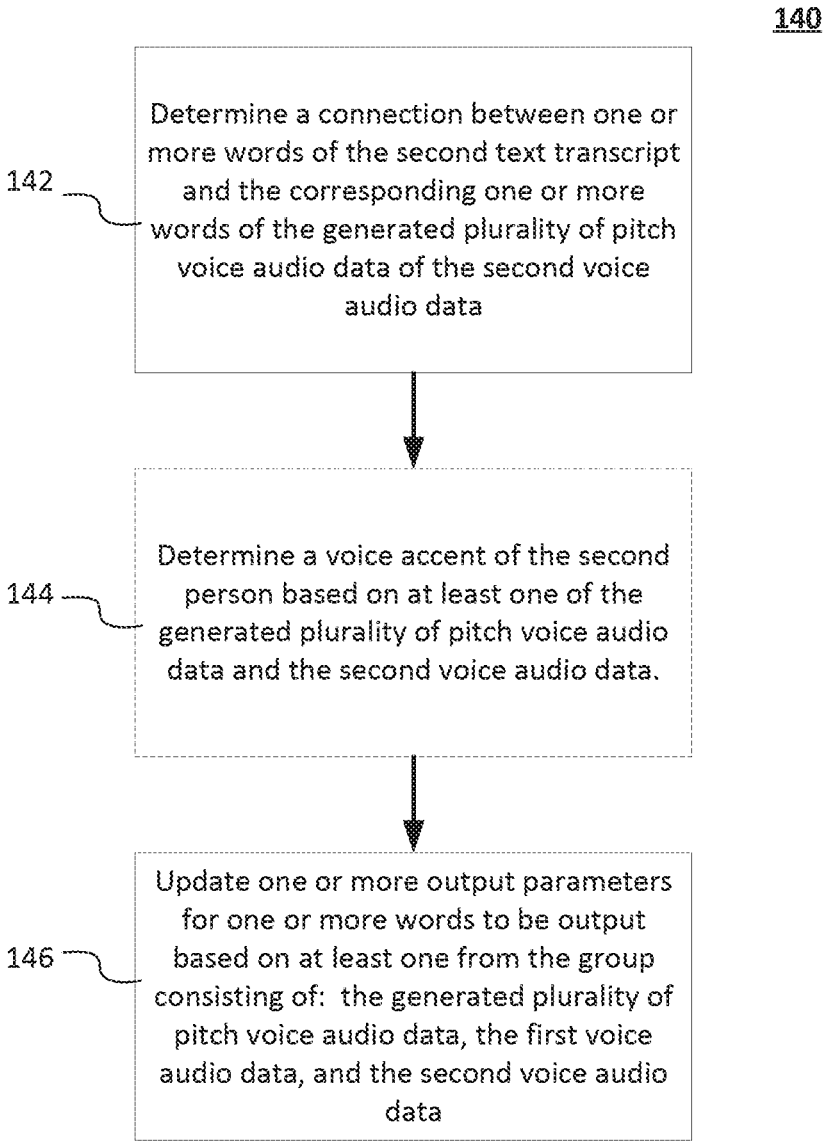

FIGS. 1A-1C show a method 100 of training an audio generation model and generating output audio according to an implementation of the disclosed subject matter. At operation 110, a computer system (e.g., a processor 200 of computer 200, central component 300, and/or second computer 400 shown in FIG. 2 and discussed below) may train an audio generation model for a first person using a first voice audio data and a first text transcript of the first voice audio data. The audio generation model and the first voice audio data and a first text transcript may be stored in a memory 270, fixed storage 230, and/or removable media 250 of computer 200, and/or stored at the central component 300, and/or storage 410 of second computer 400 shown in FIG. 2 and described below. In some implementations, the audio generation model may be trained with about 24-50 hours of first voice audio data (and the corresponding first text transcript of the first voice audio data). For example, politician speeches (e.g., a president, congressperson, political candidate, or the like) may provide the 24-50 hours of first audio data. Using the first voice audio data and the first text transcript audio generation model, the audio generation model may be trained to determine a connection between one or more words of the first text transcript and the corresponding one or more words of the first voice audio data.

In an example training process, given previous mel spectrograms and a transcript, the audio generation model may learn to predict the next mel spectrogram. Mel spectrograms may approximate the human auditory system's response by equally spacing frequency bands of voice audio data on the mel scale. Since the voice audio data may be time-based, the audio generation model may predict what the next waveform may look like (e.g., in terms of frequency and spectral distribution). In this example, a ten second audio clip (e.g., 10 seconds of the voice audio data) may be broken up and/or divided by each second of the ten seconds. Continuing with this example, the first five seconds of the audio clip may be used by the audio generation model to predict the waveform of the sixth second. In implementations of the disclosed subject matter, timings are broken down to much smaller units (based on the mel spectrograms, and not based on time), and the audio generation model may perform the breakdown many times (e.g., even repeating the breakdown on the same voice audio data) until convergence is achieved.

Errors in recognition by the audio generation model may be determined. For example, in view of the training processed discussed above, and that the mel spectrograms may be vectors, the distance between the predicted mel spectrogram and actual mel spectrogram may be determined. In the example above, the distance between the predicted mel spectrogram and actual mel spectrogram for the sixth second may be used during training of the audio generation model. After the audio generation model has been trained, errors may be determined based on testing a speaker authentication system to determine the quality of the audio generated using the audio generation model. For example, if the trained audio generation model produces audio output which is able to circumvent a speaker authentication system (e.g., of a security system or the like), the audio generation model may not have errors. In this same example, if the trained audio generation model produces audio output which is not able to circumvent the speaker authentication system, the audio generation model may have errors, and may need further training.

Text-to-speech (TTS) is generally considered to be a particularly difficult machine learning problem (e.g., training the audio generation model), as there are many permutations of speaking styles, emotions, accents, and/or pronunciations that can all map to the same text. The audio generation model of the disclosed subject matter may be initially trained with about 24-50 hours of transcribed audio (e.g., the first text transcript) in operation 110, which may be parsed into phrases and/or sentences. Mel-spectrograms may be used to "featurize" the voice audio (e.g., the first voice audio data for a first person and/or the second voice audio data for a second person), where frames of audio may be converted by the computer system (e.g., computer 200, central component 300, and/or second computer 400 shown in FIG. 2 and described below) into numerical vectors which can be used by the audio generation model.

At operation 120, the computer system may receive a second voice audio data and a second text transcript of the second voice audio data. The second voice audio data and the second text transcript may be received by computer 200 via a network interface 290, and/or stored in the memory 270, the fixed storage 230, and/or the removable media 250 of computer 200, and/or stored in central component 300, and/or the storage 410 of second computer 400 shown in FIG. 2 and described below. The amount of data of the second voice audio data may be less than an amount of data for the first audio data. For example, there may be 24-50 hours of the first audio data, and about 1 hour of second audio data (e.g., which may be initially about 5 minutes of audio data, and increased to about one hour with different pitches of audio data generated from the initial 5 minutes of audio data). In some implementations, the second audio data that may be used to train the audio generation model may be about 30 sentences.

At operation 130, the computer system may generate a plurality of pitch voice audio data for the second person with different pitches using the second voice audio data. Using the second voice audio data, the computer system may produce 20 new sets of audio data, where each of the 20 new sets of audio data may have a different pitch. This allows about 5 minutes of the second voice audio data to be converted to 1-2 hours of audio voice data. This shorter amount of audio data (i.e., 5 minutes of audio) may be easier to collect and/or transcribe into text. That is, it may be easier to produce and/or find short, high quality audio recordings that may be easier to transcribe, thus reducing the time and/or effort needed to transcribe hours of voice audio recordings.

Audio quality may relate to whether there is any background noise in the audio data, and/or whether the voice is fuzzy or unclear. These audio quality factors may impact the quality of output speech to be generated by the audio generation model. Although segments of audio may be removed that are below a predetermined threshold quality as a pre-processing step, such pre-processing may take time and computing resources, and may require that additional audio be obtained for training purposes (i.e., since some of the audio data is removed as part of this pre-processing). Transcripts may also impact the quality of output speech, where an improper transcription may affect the training of the audio generation model.

Operation 130 may be shown in more detail in FIG. 1B. At operation 132, by using at least a portion of the second voice audio data, the plurality of pitch voice audio data may be generated by the computer system (e.g., computer 200, central component 300, and/or second computer 400) so as to have pitches above and below a pitch of the portion of the second voice audio data. For example, at operation 134, pitch voice audio data may be generated for ten pitches above and ten pitches below the pitch of the portion of the second voice audio data. That is, there may be ten different pitches generated that are above a pitch of the second voice audio data used to generate the pitches, and ten different pitches below the pitch of the second voice audio data used to generate the pitches. In some implementations, an audio editor system may use software, hardware, and/or a combination thereof to generate each of the pitches above and below the second voice audio data. That is, the second voice audio data may be used as input voice data to the audio editor system. In some implementations, the audio editor may speed up or slow down the second voice audio data by a predetermined amount to generate the different pitches. For example, to generate a different pitch, the audio editor may speed up or slow down the second voice audio data by 10% from a reference pitch, such as a pitch in the second voice audio data.

The generation of the 20 different pitches of voice audio data from the initial second voice audio data (e.g., about 5 minutes of voice audio data) may generate about an hour of voice audio data. The different pitches of voice audio data may be used to train the audio generation model for the second person so as to be able to replicate the second person's accent and/or speech characteristics with generated output voice audio. Although ten different pitches above and below a reference pitch of the second voice audio data are used as an example, there may be greater or fewer pitches above and below generated.

At operation 140 shown in FIG. 1A, the audio generation model may be trained by the computer system for the second person using the generated plurality of pitch voice audio data with the different pitches for the second person. Mel-spectrograms may be used to "featurize" the second voice audio data for a second person, where frames of audio may be converted by the computer system (e.g., computer 200, central component 300, and/or second computer 400 shown in FIG. 2 and described below) into numerical vectors which can be used by the audio generation model.

In implementations of the disclosed subject matter, lower layers in the audio generation model may learn how to match text to words, and the higher layers may learn things like pitch and accent. In order to transfer to a new dataset (e.g., from the first audio data and first text transcript of the first person to the second voice audio data and second text transcript of the second person), the audio generation model may not need to change base beliefs, such as how text maps to words, which typically incurs a large training cost.

Operation 140 may be shown in more detail in FIG. 1B. To train the audio generation model at operation 142, the computer system may determine a connection between one or more words of the second text transcript and the corresponding one or more words of the generated plurality of pitch voice audio data of the second voice audio data. Optionally, at operation 144, the computer system may determine a voice accent of the second person based on at least one of the generated plurality of pitch voice audio data and the second voice audio data. At operation 146, the computer system may update one or more output parameters for one or more words to be output based on at least one of the generated plurality of pitch voice audio data, the first voice audio data, and the second voice audio data.

At operation 150 shown in FIG. 1A, the computer system may generate output voice audio for the second person using received text and the model trained with the generated plurality of pitch voice audio data. The text may be received, for example, via the network interface 290 and/or the user input interface 260 of the computer 200. At operation 160, the generated output voice audio may be output at an audio output device, such as audio output device 212 of computer 200 shown in FIG. 2 and discussed below.

In some implementations, the generated output voice audio from operation 160 may be used to determine whether a computing device, a home automation system, a security system, and/or a financial transaction system may recognize and implement a voice command operation for the second person. That is, voice command operation functionality of such systems and devices may be tested to determine whether they may recognize a command having different voices, pitches, accents, and the like.

In some implementations, the generated output voice audio from operation 160 may be used to determine a computing device, a home automation system, a security system, and/or a financial transaction system recognizes and authenticates the second person. That is, the voice recognition and/or authentication operations of such systems and devices may be tested to determine whether they may recognize and authenticate a voice. This may be used to determine successful recognition and authentication of a voice, and may also be used to determine whether the system or device may authenticate a voice of a person that is not an authorized user. For example, this may be used to determine whether the system or device may be susceptible to targeted text-to-speech attacks, so as to gain unauthorized access to a device, a financial system, and/or to a building monitored by a security system.

Figure 2:
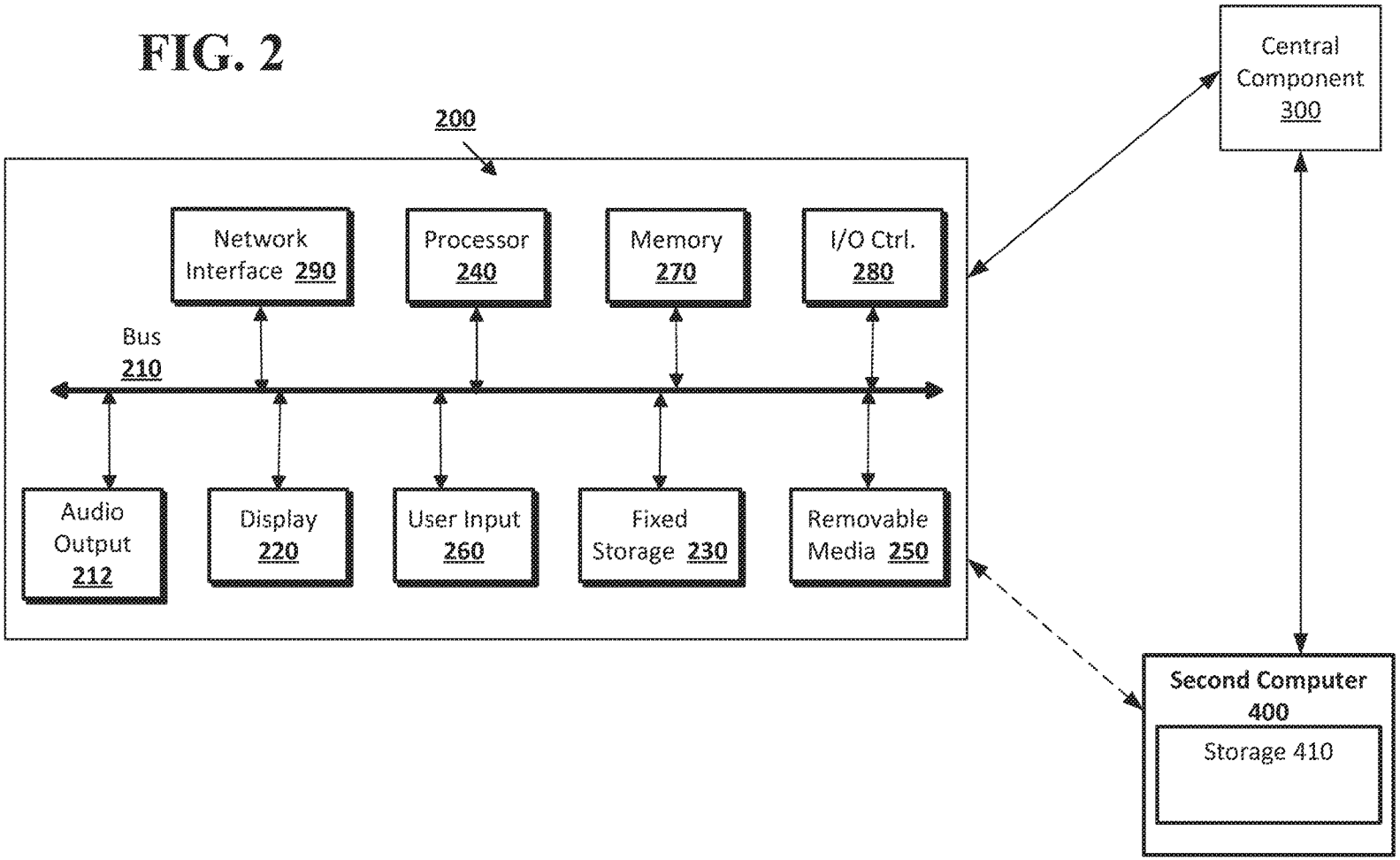
FIG. 2 shows a computer system according to an implementation of the disclosed subject matter.

Implementations of the presently disclosed subject matter may be implemented in and used with a variety of component and network architectures. FIG. 2 is an example computer 200 suitable for implementing implementations of the presently disclosed subject matter. As discussed in further detail herein, the computer 200 may be a single computer in a network of multiple computers. As shown in FIG. 2, the computer 200 may communicate with a central or distributed component 300 (e.g., server, cloud server, database, cluster, application server, neural network system, etc.). The central component 300 may communicate with one or more other computers such as the second computer 400, which may include a storage device 410. The second computer 800 may be a server, cloud server, neural network system, or the like. The storage 410 may use any suitable combination of any suitable volatile and non-volatile physical storage mediums, including, for example, hard disk drives, solid state drives, optical media, flash memory, tape drives, registers, and random access memory, or the like, or any combination thereof.

Figure 3:
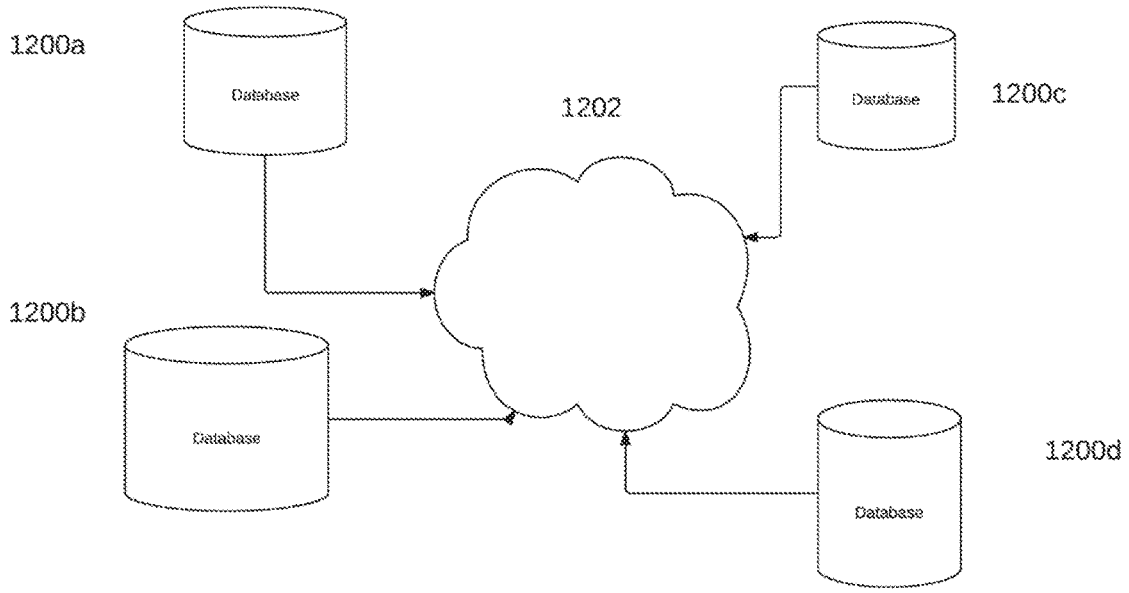
FIG. 3 show a network configuration according to an implementation of the disclosed subject matter.

Data for the audio generation model, the first voice audio data, the first text transcript, the second voice audio data, the second text transcript, the pitch voice audio data, and/or the output voice audio may be stored in any suitable format in, for example, memory 270, fixed storage 230, removable media 250, and/or the storage 410, using any suitable filesystem or storage scheme or hierarchy. For example, the storage 410 can store data (e.g., the first voice audio data, the first text transcript, the second voice audio data, the second text transcript, the pitch voice audio data, and/or the output voice audio) using a log structured merge (LSM) tree with multiple levels. Further, if the systems shown in FIGS. 2-3 are multitenant systems, the storage can be organized into separate log structured merge trees for each instance of a database for a tenant. For example, multitenant systems may be used to manage a plurality of audio generation models, voice audio data, and/or transcripts. Alternatively, contents of all records on a particular server or system can be stored within a single log structured merge tree, in which case unique tenant identifiers associated with versions of records can be used to distinguish between data for each tenant as disclosed herein. More recent transactions (e.g., second voice audio data, the second text transcript, the pitch voice audio data, and/or the output voice audio and the like) can be stored at the highest or top level of the tree and older transactions (e.g., first voice audio data, first text transcript, and the like) can be stored at lower levels of the tree. Alternatively, the most recent transaction or version for each record (i.e., contents of each record) can be stored at the highest level of the tree and prior versions or prior transactions at lower levels of the tree.

The information obtained to and/or from a central component 300 can be isolated for each computer such that computer 200 cannot share information with computer 400 (e.g., for security and/or testing purposes). Alternatively, or in addition, computer 200 can communicate directly with the second computer 400.

The computer (e.g., user computer, enterprise computer, etc.) 200 may include a bus 210 which interconnects major components of the computer 200, such as an audio output device 212, a central processor 240, a memory 270 (typically RAM, but which can also include ROM, flash RAM, or the like), an input/output controller 280, a user display 220, such as a display or touch screen via a display adapter, a user input interface 260, which may include one or more controllers and associated user input or devices such as a keyboard, mouse, Wi-Fi/cellular radios, touchscreen, microphone/speakers and the like, and may be communicatively coupled to the I/O controller 280, fixed storage 230, such as a hard drive, flash storage, Fibre Channel network, SAN device, SCSI device, and the like, and a removable media component 250 operative to control and receive an optical disk, flash drive, and the like.

The bus 210 may enable data communication between the central processor 240 and the memory 270, which may include read-only memory (ROM) or flash memory (neither shown), and random access memory (RAM) (not shown), as previously noted. The RAM may include the main memory into which the operating system, development software, testing programs, and application programs are loaded. The ROM or flash memory can contain, among other code, the Basic Input-Output system (BIOS) which controls basic hardware operation such as the interaction with peripheral components. Applications resident with the computer 200 may be stored on and accessed via a computer readable medium, such as a hard disk drive (e.g., fixed storage 230), an optical drive, floppy disk, or other storage medium 250.

The audio output device 212 may include an amplifier, one or more audio processors to adjust the characteristics of the output signal, one or more speakers, or the like to convert an output voice audio signal that may be generated by the processor 240 into sound that is output by the speaker.

The fixed storage 230 can be integral with the computer 200 or can be separate and accessed through other interfaces. The fixed storage 230 may be part of a storage area network (SAN). A network interface 290 can provide a direct connection to a remote server via a telephone link, to the Internet via an internet service provider (ISP), or a direct connection to a remote server via a direct network link to the Internet via a POP (point of presence) or other technique. The network interface 290 can provide such connection using wireless techniques, including digital cellular telephone connection, Cellular Digital Packet Data (CDPD) connection, digital satellite data connection or the like. For example, the network interface 290 may enable the computer to communicate with other computers and/or storage devices via one or more local, wide-area, or other networks, as shown in FIGS. 2-3.

Many other devices or components (not shown) may be connected in a similar manner (e.g., data cache systems, application servers, communication network switches, firewall devices, authentication and/or authorization servers, computer and/or network security systems, and the like). Conversely, all the components shown in FIGS. 2-3 need not be present to practice the present disclosure. The components can be interconnected in different ways from that shown. Code to implement the present disclosure can be stored in computer-readable storage media such as one or more of the memory 270, fixed storage 230, removable media 250, or on a remote storage location.

FIG. 3 shows an example network arrangement according to an implementation of the disclosed subject matter. Four separate database systems 1200*a-d* at different nodes in the network represented by cloud 1202 communicate with each other through networking links 1204 and with users (not shown). The database systems 1200*a-d* may be, for example, different audio generation model environments. In some implementations, the one or more of the database systems 1200*a-d* may be located in different geographic locations. Each of database systems 1200 can be operable to host multiple instances of a database (e.g., that may store audio generation models, voice audio data, text transcripts, and the like), where each instance is accessible only to users associated with a particular tenant. Each of the database systems can constitute a cluster of computers along with a storage area network (not shown), load balancers and backup servers along with firewalls, other security systems, and authentication systems. Some of the instances at any of systems 1200 may be live or production instances processing and committing transactions received from users and/or developers, and/or from computing elements (not shown) for receiving and providing data for storage in the instances.

One or more of the database systems 1200*a-d* may include at least one storage device, such as in FIG. 2. For example, the storage can include memory 270, fixed storage 230, removable media 250, and/or a storage device included with the central component 300 and/or the second computer 400. The tenant can have tenant data stored in an immutable storage of the at least one storage device associated with a tenant identifier.

In some implementations, the one or more servers shown in FIGS. 2-3 can store the data (e.g., audio generation models, voice audio data, text transcripts, and the like) in the immutable storage of the at least one storage device (e.g., a storage device associated with central component 300, the second computer 400, and/or the database systems 1200*a*-1200*d*) using a log-structured merge tree data structure.

The systems and methods of the disclosed subject matter can be for single tenancy and/or multitenancy systems. Multitenancy systems can allow various tenants, which can be, for example, developers, users, groups of users, or organizations, to access their own records (e.g., audio generation models, voice audio data, text transcripts, and the like) on the server system through software tools or instances on the server system that can be shared among the various tenants. The contents of records for each tenant can be part of a database containing that tenant. Contents of records for multiple tenants can all be stored together within the same database, but each tenant can only be able to access contents of records which belong to, or were created by, that tenant. This may allow a database system to enable multitenancy without having to store each tenants' contents of records separately, for example, on separate servers or server systems. The database for a tenant can be, for example, a relational database, hierarchical database, or any other suitable database type. All records stored on the server system can be stored in any suitable structure, including, for example, an LSM tree.

Further, a multitenant system can have various tenant instances on server systems distributed throughout a network with a computing system at each node. The live or production database instance of each tenant may have its transactions processed at one computer system. The computing system for processing the transactions of that instance may also process transactions of other instances for other tenants.

Some portions of the detailed description are presented in terms of diagrams or algorithms and symbolic representations of operations on data bits within a computer memory. These diagrams and algorithmic descriptions and representations are commonly used by those skilled in the data processing arts to most effectively convey the substance of their work to others skilled in the art. An algorithm is here and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "transmitting," "modifying," "sending," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

More generally, various implementations of the presently disclosed subject matter can include or be implemented in the form of computer-implemented processes and apparatuses for practicing those processes. Implementations also can be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also can be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium can be implemented by a general-purpose processor, which can transform the general-purpose processor or a device containing the general-purpose processor into a special-purpose device configured to implement or carry out the instructions. Implementations can be implemented using hardware that can include a processor, such as a general purpose microprocessor and/or an Application Specific Integrated Circuit (ASIC) that implements all or part of the techniques according to implementations of the disclosed subject matter in hardware and/or firmware. The processor can be coupled to memory, such as RAM, ROM, flash memory, a hard disk or any other device capable of storing electronic information. The memory can store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described to explain the principles of implementations of the disclosed subject matter and their practical applications, to thereby enable others skilled in the art to utilize those implementations as well as various implementations with various modifications as can be suited to the particular use contemplated.

The invention claimed is:

1. A method comprising:

training, at a computer system, an audio generation model for a first person using a first voice audio data and a first text transcript of the first voice audio data;

receiving, at the computer system, a second voice audio data of a second person and a second text transcript of the second voice audio data, where an amount of data of the second voice audio data is less than an amount of data for the first audio data;

generating, at the computer system, a plurality of pitch voice audio data for the second person with different pitches using the second voice audio data;

training, at the computer system, the audio generation model for the second person using the generated plurality of pitch voice audio data with the different pitches for the second person;

generating, at the computer system, output voice audio for the second person using received text and the audio generation model trained with the generated plurality of pitch voice audio data; and outputting, at an audio output device, the generated output voice audio.

2. The method of claim 1, wherein the generating the plurality of pitch voice audio data comprises:

using at least a portion of the second voice audio data, generating the plurality of pitch voice audio data having pitches above and below a pitch of the portion of the second voice audio data.

3. The method of claim 2, wherein generating the plurality of pitch voice audio data having pitches above and below a pitch of the portion of the second voice audio data comprises:

generating pitch voice audio data for ten pitches above and ten pitches below the pitch of the portion of the second voice audio data.

4. The method of claim 1, wherein the training of the audio generation model comprises:

determining, at the computer system, a connection between one or more words of the first text transcript and the corresponding one or more words of the first voice audio data.

5. The method of claim 1, wherein the training of the audio generation model comprises:

determining, at the computer system, a connection between one or more words of the second text transcript and the corresponding one or more words of the generated plurality of pitch voice audio data of the second voice audio data.

6. The method of claim 5, further comprising updating, at the computer system, one or more output parameters for one or more words to be output based on at least one from the group consisting of: the generated plurality of pitch voice audio data, the first voice audio data, and the second voice audio data.

7. The method of claim 1, wherein the training of the audio generation model comprises:

determining, at the computer system, a voice accent of the second person based on at least one from the group consisting of: the generated plurality of pitch voice audio data and the second voice audio data.

8. The method of claim 1, further comprising:

using generated output voice audio, determining whether at least one from the group consisting of: a computing device, a home automation system, a security system, and a financial transaction system recognizes and implements a voice command operation for the second person.

9. The method of claim 1, further comprising:

using generated output voice audio, determining whether at least one from the group consisting of: a computing device, a home automation system, a security system, and a financial transaction system recognizes and authenticates the second person.

10. A system comprising:

a storage device to store an audio generation model, a first voice audio data and a first text transcript of the first voice audio data, and a second voice audio data of a second person and a second text transcript of the second voice audio data, where an amount of data of the second voice audio data is less than an amount of data for the first audio data; and a processor, communicatively coupled to the storage device, to train the audio generation model for a first person using a first voice audio data and a first text transcript of the first voice audio data, to generate a plurality of pitch voice audio data for the second person with different pitches using the second voice audio data, to train the audio generation model for the second person using the generated plurality of pitch voice audio data with the different pitches for the second person, to generate output voice audio for the second person using received text and the audio generation model trained with the generated plurality of pitch voice audio data; and an audio output device to output the generated output voice audio.

11. The system of claim 10, wherein the processor generates the plurality of pitch voice audio data by generating the plurality of pitch voice audio data having pitches above and below a pitch of the portion of the second voice audio data using at least a portion of the second voice audio data.

12. The system of claim 10, wherein the processor generates the plurality of pitch voice audio data having pitches above and below a pitch of the portion of the second voice audio data by generating pitch voice audio data for ten pitches above and ten pitches below the pitch of the portion of the second voice audio data.

13. The system of claim 10, wherein the processor trains the audio generation model by determining a connection between one or more words of the first text transcript and the corresponding one or more words of the first voice audio data.

14. The system of claim 10, wherein the processor trains the audio generation model by determining a connection between one or more words of the second text transcript and the corresponding one or more words of the generated plurality of pitch voice audio data of the second voice audio data.

15. The system of claim 14, wherein the processor updates one or more output parameters for one or more words to be output based on at least one from the group consisting of: the generated plurality of pitch voice audio data, the first voice audio data, and the second voice audio data.

16. The system of claim 10, wherein the processor trains the audio generation model by determining a voice accent of the second person based on at least one from the group consisting of: the generated plurality of pitch voice audio data and the second voice audio data.

17. The system of claim 10, wherein the processor uses the generated output voice audio to determining whether at least one from the group consisting of: a computing device, a home automation system, a security system, and a financial transaction system recognizes and implements a voice command operation for the second person.

18. The system of claim 10, wherein the processor uses the generated output voice audio to determine whether at least one from the group consisting of: a computing device, a home automation system, a security system, and a financial transaction system recognizes and authenticates the second person.

* * * * *